US010370180B2

(12) United States Patent
Best et al.

(10) Patent No.: US 10,370,180 B2
(45) Date of Patent: Aug. 6, 2019

(54) PACKAGING FOR CHEWING GUM

(71) Applicant: THE TOPPS COMPANY INC., New York, NY (US)

(72) Inventors: James Joseph Best, Hewitt, NJ (US); Geoffery Joseph Lacorte, West Milford, NJ (US); Timothy Jude Kennedy, Greenwich, CT (US)

(73) Assignee: THE TOPPS COMPANY INC., New York, NY (US)

( * ) Notice: Subject to any disclaimer, the term of this patent is extended or adjusted under 35 U.S.C. 154(b) by 25 days.

(21) Appl. No.: 15/548,669

(22) PCT Filed: Feb. 5, 2016

(86) PCT No.: PCT/US2016/016835

§ 371 (c)(1),
(2) Date: Aug. 3, 2017

(87) PCT Pub. No.: WO2016/127092

PCT Pub. Date: Aug. 11, 2016

(65) Prior Publication Data

US 2018/0029788 A1 Feb. 1, 2018

Related U.S. Application Data

(60) Provisional application No. 62/113,148, filed on Feb. 6, 2015, provisional application No. 62/187,555, filed on Jul. 1, 2015.

(51) Int. Cl.
*B65D 85/60* (2006.01)
*B65D 21/02* (2006.01)
(Continued)

(52) U.S. Cl.
CPC ..... *B65D 85/60* (2013.01); *B65D 5/04* (2013.01); *B65D 21/0204* (2013.01);
(Continued)

(58) Field of Classification Search
CPC ..... B65D 85/60; B65D 25/10; B65D 25/40; B65D 81/3205; B65D 67/02
(Continued)

(56) References Cited

U.S. PATENT DOCUMENTS 6,644,488 B1 * 11/2003 Coleman ..... B65D 21/0204 206/800
7,954,671 B2 * 6/2011 Terrasi ..... B05B 11/0032 222/129
(Continued)

FOREIGN PATENT DOCUMENTS

WO WO/2013/130085 A1 9/2013
WO WO-2014/141131 A1 9/2014

OTHER PUBLICATIONS

International Search Report dated Apr. 15, 2016 in corresponding International Application No. PCT/US2016/016835, 2 pages.
(Continued)

*Primary Examiner* — Steven A. Reynolds
(74) *Attorney, Agent, or Firm* — Dentons US LLP

(57) ABSTRACT

A chewing gum package includes a dispenser, a dispenser holder, and a gum holder. The dispenser is configured to dispense a flavored liquid. The dispenser holder is configured to detachably receive and hold the dispenser. The gum holder is configured to hold a chewing gum product. The gum holder includes a first panel connected relative to and extending outward from a first side of the dispenser holder, and a second panel connected relative to and extending outward from a first side of the dispenser holder. The first panel and the second panel are configured to be movable between a closed position and an open position. The first panel and the second panel are substantially parallel to one another in the closed position to inhibit access to the chewing gum product and are not parallel to one another in the open position to increase access to the gum product.

19 Claims, 5 Drawing Sheets

(51) Int. Cl.

| | |
|---|---|
| ***B65D 81/32*** | (2006.01) |
| ***B65D 5/04*** | (2006.01) |
| ***B65D 25/10*** | (2006.01) |
| ***B65D 25/40*** | (2006.01) |
| ***B65D 67/02*** | (2006.01) |

(52) U.S. Cl.
CPC ..... *B65D 25/10* (2013.01); *B65D 25/40* (2013.01); *B65D 67/02* (2013.01); *B65D 81/3205* (2013.01)

(58) Field of Classification Search
USPC ..... 206/223, 216; 426/5
See application file for complete search history.

(56) References Cited

U.S. PATENT DOCUMENTS

| | | | | |
|---|---|---|---|---|
| 8,006,860 | B2 * | 8/2011 | Klein | B65D 77/044 206/800 |
| 2003/0118700 | A1 | 6/2003 | Hart et al. | |
| 2005/0130090 | A1 * | 6/2005 | Santoro | F23Q 2/32 431/253 |
| 2005/0252809 | A1 | 11/2005 | Aldridge et al. | |
| 2006/0051457 | A1 * | 3/2006 | Bougoulas | B65D 83/0472 426/5 |
| 2007/0186924 | A1 | 8/2007 | Terrasi | |
| 2011/0309096 | A1 | 12/2011 | Jones | |
| 2012/0138492 | A1 * | 6/2012 | Gruber | B42F 7/14 206/232 |
| 2012/0325711 | A1 * | 12/2012 | Markovic | B65D 5/04 206/459.5 |

OTHER PUBLICATIONS

Written Opinion of the International Searching Authority dated Apr. 15, 2016 in corresponding International Application No. PCT/US2016/016835, 3 pages.

Extended European Search Report issued in related European Patent Application No. 16747360.2 dated Sep. 20, 2018.

* cited by examiner

PACKAGING FOR CHEWING GUM

CROSS-REFERENCE TO RELATED PATENT APPLICATIONS

The present application is a U.S. National Stage of International Application No. PCT/US2016/016835 filed on Feb. 5, 2016, which claims the benefit of U.S. Provisional Patent Application Nos. 62/113,148 filed on Feb. 6, 2015, and 62/187,555 filed on Jul. 1, 2015, the entire disclosures of all of which are incorporated herein by reference.

FIELD

The disclosure relates generally to packaging for chewing gum.

BACKGROUND

Chewing gum is a highly popular candy product. Gum often is packaged in its basic form. For example, sticks of gum may be individually wrapped in paper or similar sheet material and held together in a pack by a foil-like material. Packaging for chewing gum is typically quite simple. Its intended uses include holding or packaging the chewing gum, while allowing easy access to the gum and creating minimal waste.

Chewing gum typically has not been provided or packaged in a way that allows a consumer to control the taste. As a comparative example, some conventional non-chewing-gum candy products have packaging that includes a liquid dispenser that allows the consumer to apply liquid to the packaged candy so that they can be consumed together. The liquid dispenser allows a consumer to adjust the taste of the candy to his or her preference by dispensing varying amounts of liquid onto the candy, thereby altering its flavor and extending the length of time the flavor of the candy will remain during consumption. At least one conventional chewing gum product is known to have a liquid filled center. However, that approach does not provide the same experience and control to the consumer.

SUMMARY

It is desired to provide an improved chewing gum package that provides a unique and controlled tasting experience to a consumer.

One embodiment of the present invention relates to a chewing gum package including a dispenser, a dispenser holder, and a gum holder. The dispenser is configured to dispense a flavored liquid. The dispenser holder is configured to detachably receive and hold the dispenser. The gum holder is configured to hold a chewing gum product. The gum holder includes a first panel connected relative to and extending outward from a first side of the dispenser holder, and a second panel connected relative to and extending outward from a first side of the dispenser holder. The first panel and the second panel are configured to be movable between a closed position and an open position. The first panel and the second panel are substantially parallel to one another in the closed position to inhibit access to the chewing gum product and are not parallel to one another in the open position to increase access to the gum product.

DETAILED DESCRIPTION

Figure 1:
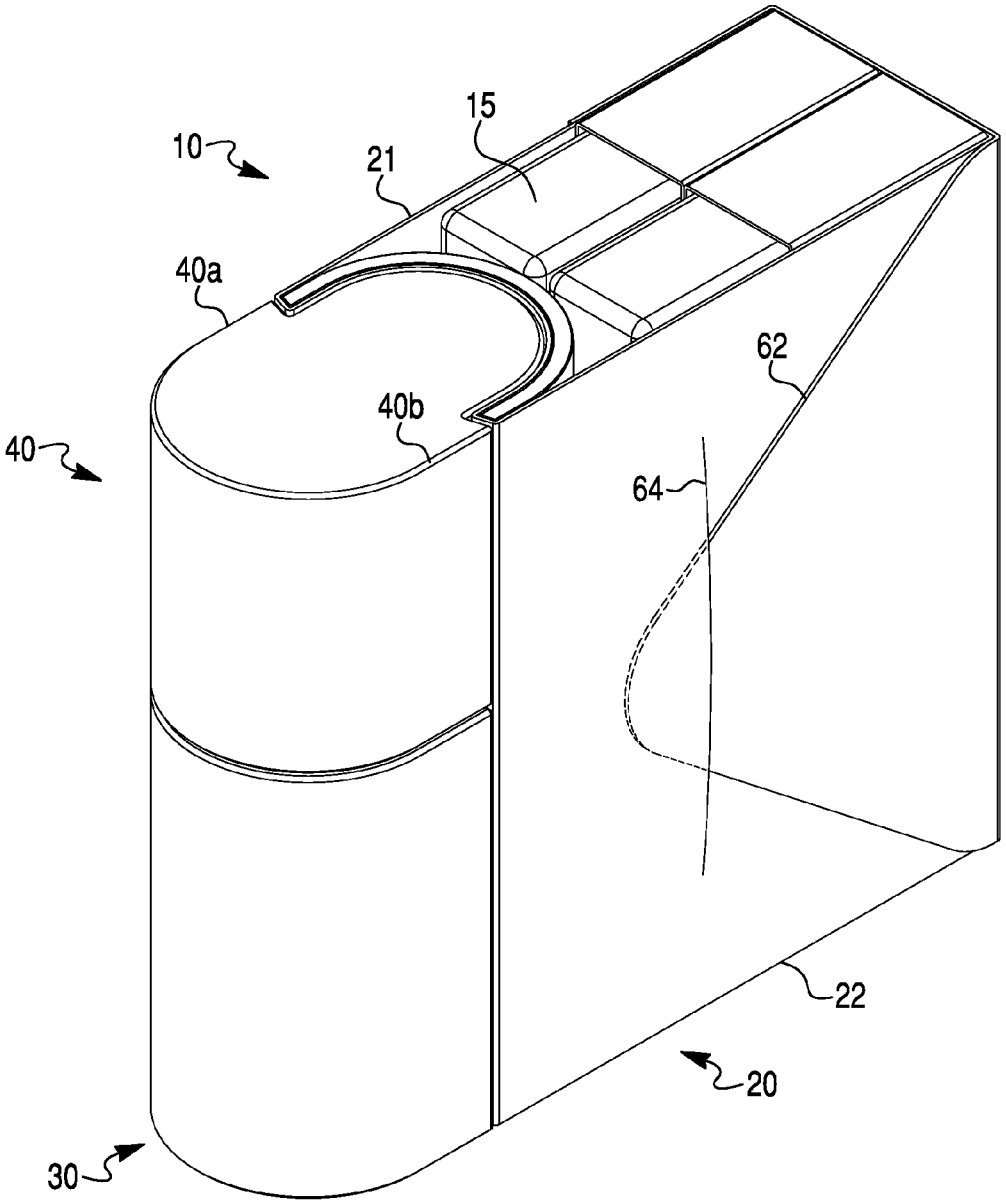
FIG. 1 is a perspective view of a chewing gum package in a closed position according to an embodiment of the present invention.
Figure 2:
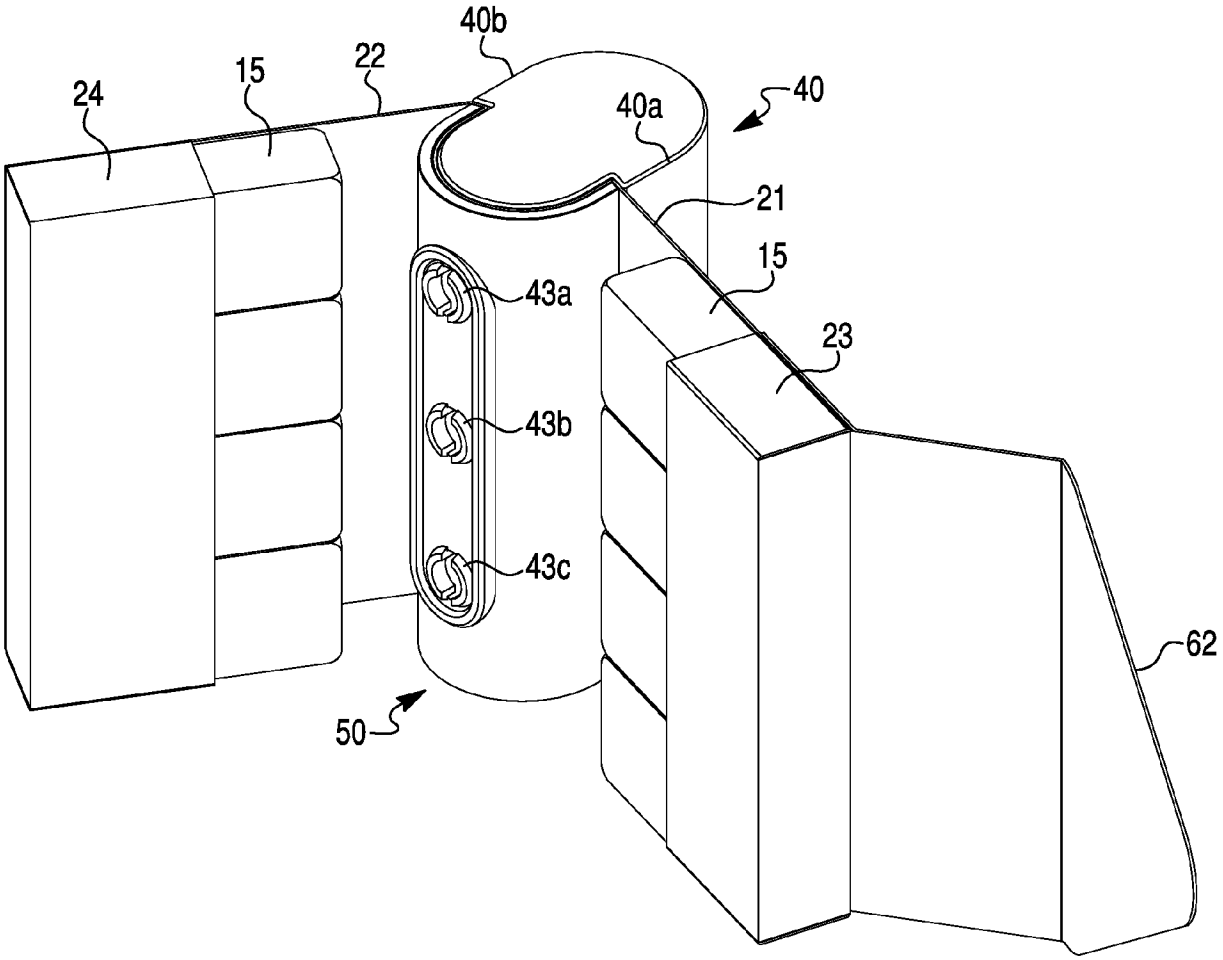
FIG. 2 is a perspective view of the chewing gum package of FIG. 1 in an open position.

Referring generally to the figures, disclosed herein are embodiments of packaging for chewing gum. The package for chewing gum includes a gum holder that provides access to a chewing gum product and a dispenser, detachably held by a dispenser holder, which allows a consumer to dispense a flavored liquid onto the chewing gum product for a unique and controlled tasting experience. In addition, by dispensing the flavored liquid onto the chewing gum product, the length of time that the flavor of the chewing gum product will remain during consumption may be extended. Embodiments of such packaging are described below FIGS. 1 and 2 show various perspective views of a chewing gum package 10 according to an embodiment. The chewing gum package 10 is shaped generally like a notebook and includes a gum holder 20, a dispenser 30, and a dispenser holder 40.

As shown in FIGS. 1 and 2, the gum holder 20 is configured to hold a chewing gum product 15, which may be in the form of a plurality of individually wrapped gum pieces. The gum holder 20 generally includes a first panel 21 and a second panel 22. The first panel 21 is connected relative to and extends outward from a first side 40*a* of the dispenser holder 40, while the second panel 22 is connected relative to and extends outward from a second side 40*b* of the dispenser holder 40. The first panel 21 and the second panel 22 are movable between a closed position and an open position. For example, as shown in FIG. 1, in the closed position, the first panel 21 and the second panel 22 are spaced close together and are substantially parallel to one another such that access to the chewing gum product 15 is inhibited. As shown in FIG. 2, in the open position, the first panel 21 and the second panel 22 are spaced apart and are not parallel to one another such that access to the chewing gum product 15 is increased, allowing a consumer to remove the chewing gum product 15 from the gum holder 20 for consumption.

Figure 3:
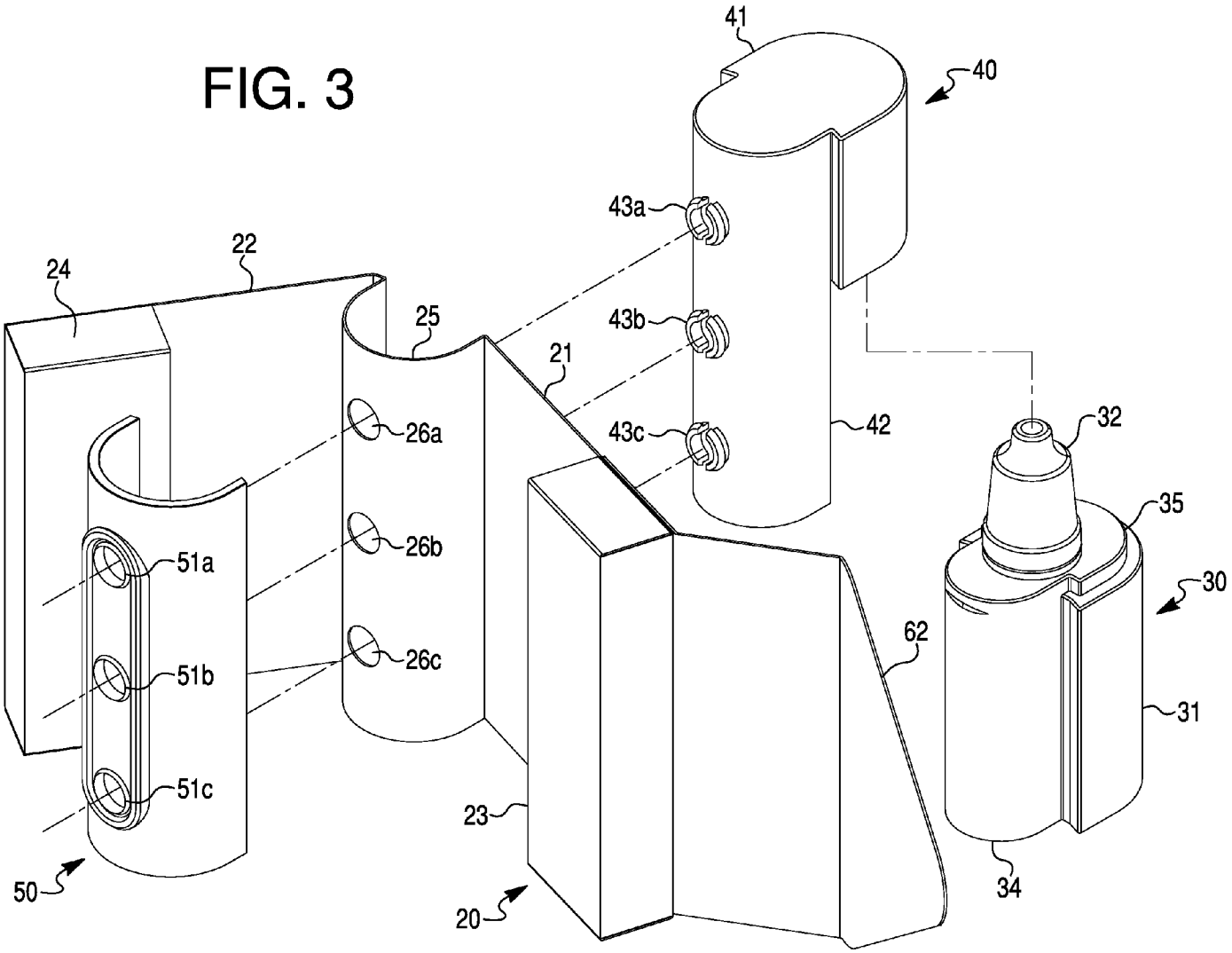
FIG. 3 is an exploded perspective view of the chewing gum package of FIG. 1.

FIG. 3 illustrates an exploded perspective view of the chewing gum package 10. In the embodiment shown in FIG. 3, the gum holder 20 is shown to be formed primarily from a flat, sheet-like material, such as paper, cardboard, or plastic, having the appropriate structural integrity and other desired characteristics to retain the chewing gum product 15. The first panel 21 may include a first compartment 23 disposed on an inner surface of the first panel 21, which holds the chewing gum product 15. The second panel 22 may also include a second compartment 24 disposed on an inner surface of the second panel 22, which holds additional chewing gum product 15. The first compartment 23 and the second compartment 24 may be formed as containers having recesses. The recesses allow the chewing gum product to be slid into or otherwise inserted into the first and second compartments 23, 24 such that the chewing gum product 15 is held within the first and second compartments. In some embodiments, the first and second compartments 23, 24 may be integrally formed with the first and second panels 21, 22, respectively. For example, the first and second panels 21, 22 may include flaps integrally formed at edges of the first and second panels 21, 22. The flaps may then be folded relative to the first and second panels 21, 22 and connected to form the first and second compartments 22, 23. In other embodiments, the first and second compartments 23, 24 may be separate components that slide into or are otherwise attached to the first and second panels 21, 22.

To secure the gum holder 20 in its closed position such that the first and second panels remain substantially parallel to one another and access to the chewing gum product 15 is inhibited, the first panel 22 may include a securement flap 62. The securement flap 62 may be configured to fold over and attach to the second panel 22 when the gum holder 20 is in its closed position. For example, as shown in FIG. 1, the securement flap 62 may be inserted into a slit 64 formed in the second panel 22. In other embodiments, however, a removable and flexible band may be used to secure the first and second panels 21, 22 in the closed position.

In addition, as shown in FIG. 3, the gum holder 20 may further include a third panel 25. The first panel 21 and the second panel 22 may be connected to the third panel 25 such that the third panel 25 is disposed between the first panel 21 and the second panel 22. In some embodiments, the third panel 25 is integrally formed with the first panel 21 and the second panel 22 such that the first panel 21, second panel 22, and the third panel 25 are formed as one sheet that is later shaped to form the gum holder 20. In other embodiments, the third panel 25 may be a separate component that is attached to the first and second panels 21, 22. The third panel 25 may include at least one opening to allow the dispenser holder 40 to be secured to the third panel 25, which will be described in more detail below. In the embodiment shown in FIG. 3, the third panel 25 includes three circular openings 26*a*-26*c*.

Figure 5:
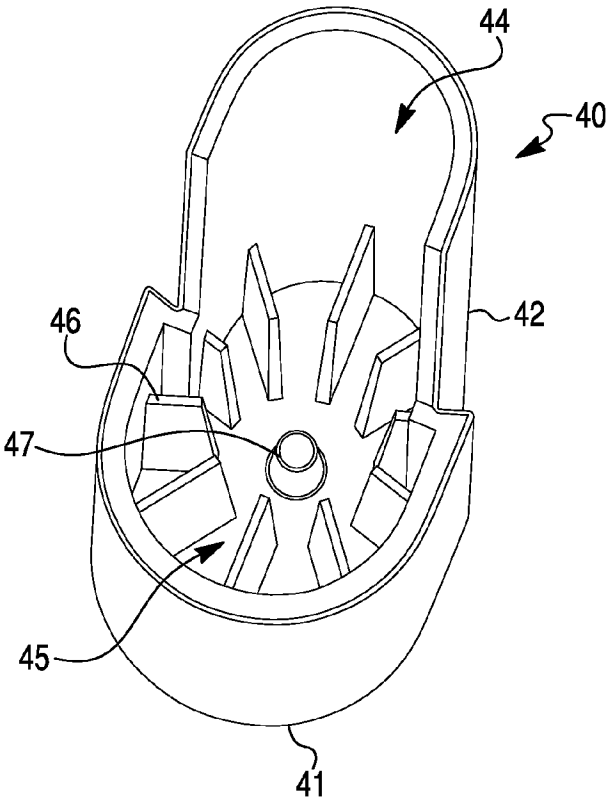
FIG. 5 is a bottom perspective view of the dispenser holder of FIG. 4.
Figure 4:
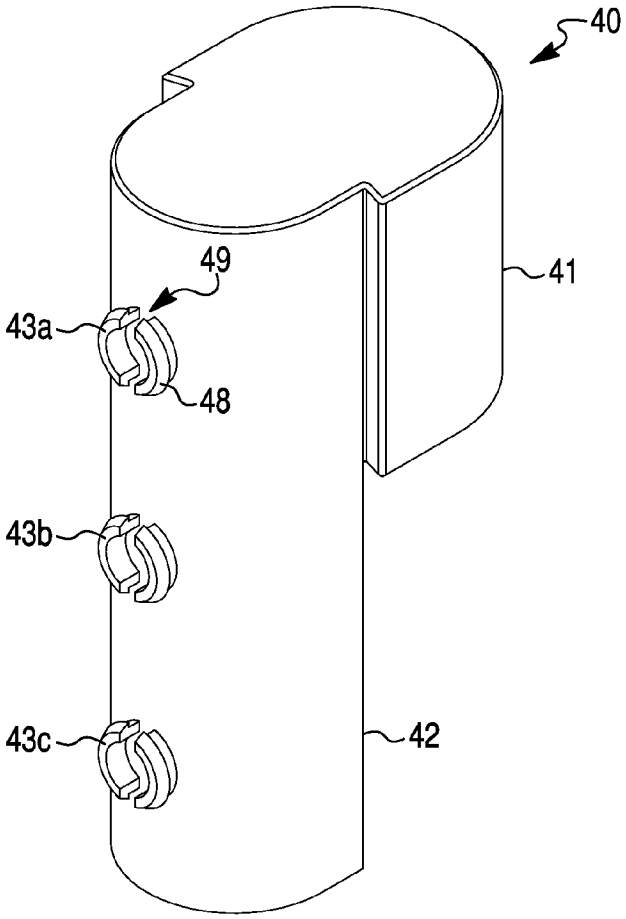
FIG. 4 is a perspective view of a dispenser holder for the chewing gum package of FIG. 1.

FIGS. 4 and 5 illustrate a dispenser holder 40 according to one embodiment. As shown in FIG. 4, the dispenser holder 40 includes a cap 41 and a main body 42. The cap 41 is generally semi-oval or semi-circular in shape, while the main body 42 is also generally semi-oval or semi-circular in shape. However, as shown in FIG. 4, the cap 41 may include a greater diameter than the main body 42 such that the cap 41 extends further outward on either side of the main body 42.

As shown in FIG. 5, the cap portion 41 may include an inner cavity 45, which is shaped to receive a first portion of the dispenser 30. In addition, the main body 42 may include a guide recess 44, which is shaped to receive a second portion of the dispenser 30. As further shown in FIG. 5, a plurality of guiding ribs 46 and a nozzle-receiving projection 47 are formed at a bottom, inner surface of the inner cavity 45. The nozzle-receiving projection 47 is formed at a center of the bottom, inner surface of the inner cavity 45, while the plurality of guiding ribs 46 are formed along an inner periphery of the inner cavity 45 and project inwardly toward the nozzle-receiving projection 47. The plurality of guiding ribs 46 may be shaped (e.g., angled) so as to guide the dispenser 30 to the nozzle-receiving projection 47 when the dispenser 30 is received into the dispenser holder 40.

Figure 6:
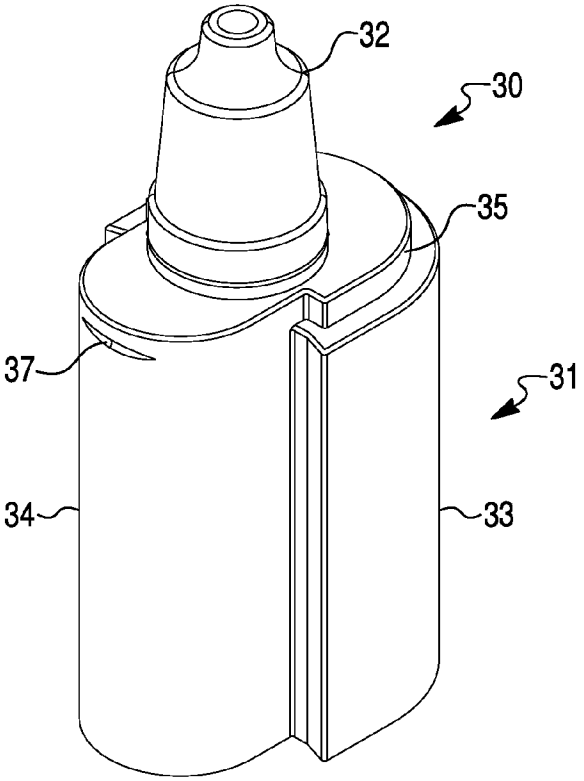
FIG. 6 is a perspective view of a dispenser for the chewing gum package of FIG. 1.

FIG. 6 illustrates a dispenser 30 that may be detachably received and held in the dispenser holder 40 according to one embodiment. The dispenser 30 includes a reservoir 31 and a nozzle 32. The reservoir 31 is configured to hold a flavored liquid, which may be, for example, a sweet and/or sour flavored liquid. The nozzle 32 is configured to dispense the flavored liquid from the reservoir 31. The reservoir 31 may be made of a material, such as plastic, that is sufficiently flexible so that the flavored liquid can be squeezed from the reservoir 31 and expelled through the nozzle 32, but not so flexible that the flow of liquid is difficult to control. In addition, the reservoir 31 may be translucent or transparent so that the amount of liquid remaining in the reservoir 31 may be easily ascertained by the consumer. The nozzle 32 may be connected to the reservoir 31 by a locking thread, glue, snap-fit, or other connection that effectively prevents the nozzle 32 from being detached from the reservoir 31 during normal use. It is preferable that the nozzle 32 is permanently attached to the reservoir 31, such as through a one-way snap-fit or other permanent adhesion, such that choking hazards are eliminated or minimized.

As further shown in FIG. 6, the reservoir 31 generally includes a cross-sectional shape that substantially matches the cross-sectional shape of the dispenser holder 40. In other words, the reservoir 31 includes a main portion 33 that is substantially semi-oval or semi-circular in shape, and a guide portion 34 that is also substantially semi-oval or semi-circular in shape. The guide portion 34 is configured to be received in and slide within the guide recess 44 of the main body 42. The main portion of the reservoir 31 is configured to have substantially the same diameter as the cap 41 of the dispenser holder 40 such that the main portion 33 is substantially flush with the outer surface of the cap 41 when the dispenser 30 is received in the dispenser holder 40. The reservoir 31 may further include a step portion 35 disposed on a top surface of the main portion 33. The step portion 35 may be configured to be received within the cap 41 of the dispenser holder 40. In addition, one or more notches 37 may be included on an outer surface of the guide portion 34 and/or step portion 35. The notch 37 may be configured to engage with a peripheral rim (not shown) formed on an inner surface of the dispenser holder 40 within the inner cavity 45.

When the dispenser 30 is received in the dispenser holder 40, the guide portion 34 of the dispenser 30 slides along the guide recess 44 of the dispenser holder 40. As the nozzle 32 enters the inner cavity 45 of the cap portion 41, the nozzle 32 is guided to the nozzle-receiving projection 47 by the guiding ribs 46. The nozzle-receiving projection 47 may then be received into the opening of the nozzle 32 such that the nozzle 32 and the nozzle-receiving projection 47 form a detachable connection, such as a snap-detent connection. The connection is sufficient to hold the dispenser 30 within the dispenser holder 40 and seal the nozzle 32 such that liquid is prevented from being released from the reservoir 31, but still allow the consumer to remove the dispenser 30 from the dispenser holder 40 by imparting a pulling force on the dispenser 30. In addition, the notch 37 may engage with the peripheral rim of the dispenser holder 40 to provide an additional connection to hold the dispenser 30 within the dispenser holder 40.

Figure 7:
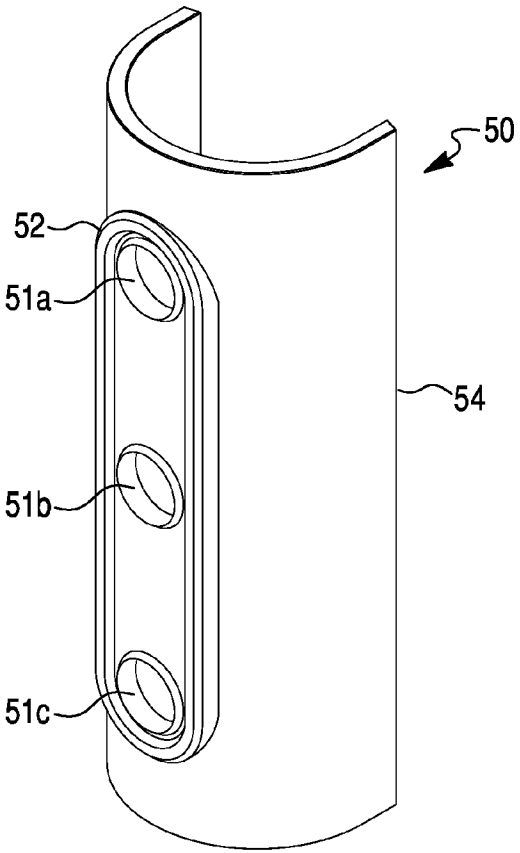
FIG. 7 is a perspective view of a component for an attachment mechanism for the chewing gum package of FIG. 1.

FIG. 7 illustrates a component of an attachment mechanism 50, which may be used to secure the dispenser holder 40 to the gum holder 20, according to one embodiment. As shown in FIG. 7, the attachment mechanism 50 includes a clip body 54 having a generally semi-oval or semi-circular shape so as to receive the main body 42 of the dispenser holder 20. The clip body 54 of the attachment mechanism 50 includes at least one engagement hole. For example, as shown in FIG. 7, clip body 54 may include three engagement holes 51*a*-51*c*. The clip body 54 may also include a protruding ring 52, which surrounds the engagement holes 51*a*-52*c*. The attachment mechanism 50 further includes at least one protrusion formed on the main body 42 of the dispenser holder 40 (e.g., as shown in FIG. 4), which engage with the engagement holes to secure the dispenser holder 40 to the gum holder 20. In the embodiment shown in FIG. 4, the attachment mechanism 50 includes three protrusions 43*a*-43*c* formed on the main body 42 to correspond with each of the three engagement holes 51*a*-51*c*. The protrusions 43*a*-43*c* may be circular in shape and include one or more cutouts 49 such that each of the protrusions 43*a*-43*c* forms a pair of deflective fingers. In addition, each of the protrusions 43*a*-43*c* may also include a circumferential lip 48. The protruding ring 52 may be configured to provide a flush surface to the attachment mechanism 50 when the protrusions 43*a*-43*c* engage with the engagement holes 51*a*-51*c* (e.g., as shown in FIG. 2).

To secure the dispenser holder 40 to the gum holder 20 using the attachment mechanism 50, the third panel 25 of the gum holder 20 is placed on the main body 42 of the dispenser holder 40 such that the protrusions 43*a*-43*c* extend through the corresponding openings 26*a*-26*c* of the third panel 25, as shown in FIG. 3. The clip body 54 of the attachment mechanism 50 may then be placed over the third panel 25 and attached to the dispenser holder 40 by engaging the engagement holes 51*a*-51*c* with the corresponding protrusions 43*a*-43*c*. When using the attachment mechanism 50 to secure dispenser holder 40 to the gum holder 20, the deflective fingers of the protrusions 43*a*-43*c* deform inwardly as the protrusions 43*a*-43*c* pass through the corresponding engagement holes 51*a*-51*c*. When the circumferential lips 48 of the protrusions 43*a*-43*c* pass through the engagement holes 51*a*-51*c*, the deflective fingers deflect outwardly such that the circumferential lips 48 prevent removal of the dispenser holder 40 from the clip body 54 of the attachment mechanism 50 through a snap-fit connection. With such a configuration, the third panel 25 is then sandwiched between the dispenser holder 40 and the clip body 54 of the attachment mechanism 50 such that the dispenser holder 40 is secured to the gum holder 20. In addition, the attachment mechanism 50 is configured so that when the attachment mechanism 50 secures the dispenser holder 40 to the gum holder 20, the outer surface of the clip body 54 of the attachment mechanism 50 is substantially flush with the outer surface of the cap 41 of the dispenser holder 40 and the main portion 33 of the reservoir 31. Once attached, the dispenser 30, the dispenser holder 40, and the attachment mechanism 50 together form the "spine" of the notebook-like chewing gum package 10, as shown, for example, in FIG. 2.

Although the dispenser holder 40 is shown as being secured to the gum holder 20 using the attachment mechanism 50 as shown in the figures, the dispenser holder 40 may be secured to the gum holder 20 using other means. For example, the attachment mechanism 50 may include only the protrusions 43*a*-43*c* formed on the main body 42 of the dispenser holder 40. The protrusions 43*a*-43*c* may then be used to secure the dispenser holder 40 to the openings 26*a*-26*c* without the use of the clip body 54. In addition, attachment mechanisms in other forms (e.g., clips or fasteners) may be integrally formed on the dispenser holder 40 and configured to attach to the third panel 25 of the gum holder 20 without the use of the clip body 54. Alternatively, the dispenser holder 40 may include insertion slits as an attachment mechanism. The insertion slits may be formed on each of the first and second sides 40*a*, 40*b* of the dispenser holder 40. The first and second panels 21, 22 may then be inserted into the insertion slits to connect to the first and second sides of the dispenser holder 40, thus foregoing the use of a third panel 25. In other embodiments, the attachment mechanism may be an adhesive material, such as glue, tape, or the like. The dispenser holder 40 may be attached to the first, second, and/or third panels using the adhesive material. Moreover, while the dispenser holder 40 and the dispenser 30 are shown placed at an outside of the gum holder 20 as shown in FIGS. 1-3, the dispenser holder 40 and the dispenser 30 may alternatively be placed at an inside of the gum holder 20 such that the consumer opens the gum holder 20 in order to gain access to the dispenser 30.

To use the chewing gum package 10, the consumer opens the gum holder 20 by releasing the securement flap 62 from the slit 64, which allows the consumer to move the first panel 21 and the second panel 22 into the open position (e.g., FIG. 2). The consumer can then access the chewing gum product 15 and remove a piece of the chewing gum product 15 from the first compartment 23 or the second compartment 24. The dispenser 30 may be removed from the dispenser holder 40 before or after removing a piece of the chewing gum product 15. To remove the dispenser 30, the consumer may pull the dispenser 30 downward and away from the cap 41 of the dispenser holder 40. By pulling the dispenser 30, the nozzle 37 disengages from the nozzle-receiving projection 47 and the notch 37 disengages from the dispenser holder 40. The consumer may then slide the guide portion 34 of the dispenser 30 along the guide recess 44 of the main body 42 to remove the dispenser 30 for use. The consumer can then squeeze the reservoir 31 of the dispenser 30 so that the flavored liquid may be expelled through the nozzle 32, which the consumer can then apply to an unwrapped piece of the chewing gum product 15. With the dispenser 30, the consumer can control the amount of flavored liquid applied to the piece of chewing gum product 15 and thus control the overall taste of the chewing gum product 15. In addition, the consumer can extend the length of time the piece of chewing gum product 15 will retain its overall flavor during consumption. After application of the flavored liquid, the consumer may then reinsert the dispenser 30 into the dispenser holder 40 by sliding the guide portion 34 along the guide recess 44 of the main body 42 and pressing the nozzle 32 of the dispenser 30 into the cavity 45 of the cap portion 41, where the nozzle 32 is guided by the guiding ribs 46 until the nozzle 32 snaps with the nozzle-receiving projection 47 to detachably hold and seal the dispenser 30 in the dispenser holder 40. The gum holder 20 may also be closed by the consumer by moving the first and second panels 21, 22 to the closed position and inserting the securement flap 62 into the slit 64 to allow the chewing gum package 10 to be secured and stored for later use.

The various components described in the embodiments above are preferably sized and assembled to pass safety standards. However, the invention is not so limited.

In addition, the invention is not limited to the specific embodiments disclosed herein. For example, the invention can be used with any type of gum and any flavored liquid. The specific configurations shown in the embodiments may be modified in ways that are immaterial to the overall invention. Additionally, any single feature of one embodiment of the present invention may be used in any other embodiment of the present invention.

Given the disclosure of the present invention, one versed in the art would appreciate that there may be other embodiments and modifications within the scope and spirit of the invention. Accordingly, all modifications attainable by one versed in the art from the present invention within the scope and spirit of the present invention are to be included as further embodiments of the present invention.

What is claimed is:

1. A chewing gum package comprising:

a gum holder configured to hold a chewing gum product and comprising (a) a first panel, (b) a second panel, and (c) a third panel connected between and to both the first panel and the second panel, the third panel and the first panel being connected to each other along a first line, the third panel and the second panel being connected to each other along a second line that is parallel to the first line;

a dispenser configured to contain and dispense a liquid; and a separate dispenser holder attached to a first side of the third panel, the dispenser holder being configured to detachably receive and hold the dispenser, wherein, at least one of the first panel or the second panel is hingedly connected to the third panel so that the first panel and the second panel are hingedly movable relative to each other about the first line, the second line, or both the first line and the second line to thereby place the gum holder in a closed condition or an open condition, the first panel and the second panel are spaced apart and substantially parallel to one another when the gum holder is in the closed condition to inhibit access to the chewing gum product and are not parallel to one another the gum holder is in the open condition to increase access to the chewing gum product, and the first panel, second panel, and third panel define a space enclosed on three sides at a second side of the third panel when the gum holder is in the closed condition.

2. The chewing gum package of claim 1, wherein each of the first panel and the second panel includes a compartment in which chewing gum can be received, the compartment of the first panel facing the second panel and the compartment of the second panel facing the first panel when the gum holder is in the closed condition.

3. The chewing gum package of claim 1, further comprising an attachment mechanism configured to secure the dispenser holder to the gum holder.

4. The chewing gum package of claim 1, further comprising an attachment mechanism configured to secure the dispenser holder to the third panel.

5. The chewing gum package of claim 1, wherein the dispenser further comprises a reservoir configured to hold the liquid and a nozzle configured to expel the liquid.

6. The chewing gum package of claim 5, wherein the dispenser holder further comprises a cap configured to receive the nozzle and a main body configured to receive the reservoir.

7. The chewing gum package of claim 6, wherein the reservoir further comprises a guide portion configured to be received and slide within the main body of the dispenser holder.

8. The chewing gum package of claim 6, wherein the cap further comprises a nozzle-receiving portion disposed on an inner surface of the cap and configured to detachably connect to the nozzle when the dispenser is received in the dispenser holder.

9. The chewing gum package of claim 1, wherein the dispenser holder further comprises a cap configured to receive a first portion of the dispenser and a main body configured to receive a second portion of the dispenser.

10. The chewing gum package of claim 1, wherein the first panel comprises a securement flap configured to secure together the first panel and the second panel when the gum holder is in the closed condition.

11. The chewing gum package of claim 10, wherein the second panel comprises a slit configured to receive the securement flap when the gum holder is in the closed condition.

12. The chewing gum package of claim 1, wherein the first panel comprises a first compartment configured to hold the chewing gum product.

13. The chewing gum package of claim 12, wherein the second panel comprises a second compartment configured to hold a second chewing gum product.

14. The chewing gum package of claim 1, wherein the first panel, second panel, and third panel are made of paper, cardboard, or plastic.

15. The chewing gum package of claim 1, comprising gum held within the space enclosed on three sides by the first panel, the second panel, and the third panel.

16. The chewing gum package of claim 1, wherein the first panel, second panel, and third panel are sections of a unitary sheet created by fold lines of the sheet.

17. The chewing gum package of claim 16, wherein the unitary sheet is made of paper, cardboard, or plastic.

18. A chewing gum package comprising:

a dispenser configured to dispense a flavored liquid;

a dispenser holder configured to detachably receive and hold the dispenser; and a gum holder configured to hold a chewing gum product, the gum holder comprising (a) a first panel connected relative to and extending outward from a first side of the dispenser holder, (b) a second panel connected relative to and extending outward from the first side of the dispenser holder, (c) a third panel, the first panel and the second panel being connected to the third panel such that the third panel is disposed between the first panel and the second panel, and (d) an attachment mechanism configured to secure the dispenser holder to the third panel, wherein, the first panel and the second panel are configured to be movable relative to each other thereby to place the gum holder in an open condition or a closed condition, the first panel and the second panel are substantially parallel to one another but spaced apart when the gum holder is in the closed condition to inhibit access to the chewing gum product and are not parallel to one another when the gum holder is in the closed condition to increase access to the chewing gum product, and the third panel comprises at least one opening, and the attachment mechanism comprises a clip body having at least one engagement hole and at least one protrusion formed on the dispenser holder such that when the attachment mechanism secures the dispenser holder to the third panel, the at least one protrusion extends through the at least one opening and engages with the at least one engagement hole.

19. A chewing gum package comprising:

a dispenser configured to dispense a flavored liquid, the dispenser comprising a reservoir configured to hold the flavored liquid and a nozzle configured to expel the flavored liquid;

a dispenser holder configured to detachably receive and hold the dispenser; and a gum holder configured to hold a chewing gum product, the gum holder comprising (a) a first panel connected relative to and extending outward from a first side of the dispenser holder, (b) a second panel connected relative to and extending outward from the first side of the dispenser holder, and (c) a third panel, the first panel and the second panel being connected to the third panel such that the third panel is disposed between the first panel and the second panel, wherein the dispenser holder is secured to the third panel, the dispenser holder comprises a cap configured to receive the nozzle and a main body configured to receive the reservoir, the cap comprises a nozzle-receiving portion disposed on an inner surface of the cap and configured to detachably connect to the nozzle when the dispenser is received in the dispenser holder, the cap further comprises guiding ribs configured to guide the nozzle to the nozzle-receiving portion when the dispenser is received in the dispenser holder, the first panel and the second panel are configured to be movable relative to each other thereby to place the gum holder in a closed condition or an open condition, and the first panel and the second panel are substantially parallel to one another but spaced apart when the gum holder is in the closed condition to inhibit access to the chewing gum product and are not parallel to one another when the gum holder is in the open condition to increase access to the chewing gum product.

* * * * *